United States Patent [19]

Schloss

[11] 4,044,772

[45] Aug. 30, 1977

[54] APPARATUS FOR CARDIOVASCULAR CONDITIONING AND OTHER PHYSIOLOGICAL PURPOSES

[76] Inventor: Benjamin Schloss, 6961 Valjean Ave., Van Nuys, Calif. 91406

[21] Appl. No.: 671,592

[22] Filed: Mar. 29, 1976

[51] Int. Cl.[2] ..... A61H 33/06

[52] U.S. Cl. ..... 128/371; 4/160

[58] Field of Search ..... 128/293, 371, 373, 374, 128/375, 24.1, 256, 2 S, 2.08 G; 4/160, 163

[56] References Cited

U.S. PATENT DOCUMENTS

| | | | |
|---|---|---|---|
| 2,098,316 | 11/1937 | Sittler | 128/373 |
| 2,184,644 | 12/1939 | Homberger | 128/371 |
| 2,821,982 | 2/1958 | Lyburn | 128/371 |
| 3,271,786 | 9/1966 | Joy | 4/160 |
| 3,419,915 | 1/1969 | Clark | 4/160 |

*Primary Examiner*—Lawrence W. Trapp
*Attorney, Agent, or Firm*—Howard A. Silber

[57] ABSTRACT

An apparatus for cardiovascular conditioning, alternative bodily waste elimination and other physiological purposes includes a chamber in which a person is subjected to an environmental temperature elevated sufficiently to cause profuse sweating and increased heart rate. Very low humidity air is blown across the persons's body to achieve rapid evaporation of the perspiration. A dehumidifying system which may be associated with the chamber includes means for recovering the evaporated perspiration and expired moisture.

Heart exercise is achieved by a regimen of periodic sessions in the chamber, over the course of which the environmental temperature progressively is raised to place increasing demand on the heart and vascular system. Cardiovascular conditioning results from the increased heart activity and concomitant increased blood flow to the eccrine glands that produce the perspiration. The person is quite comfortable, since the rapid sweat evaporation leaves the body surface comparatively dry, with very little increase in internal body temperature.

The apparatus can be used as a substitute for an artificial kidney, since the waste products in blood can be eliminated by sweat glands. The patient remains in the chamber until the amount of recovered evaporated perspiration has a urea and uric acid, creatinine, etc. content equivalent to that which normally would be eliminated by the kidneys in the time between sessions in the chamber.

28 Claims, 6 Drawing Figures

Fig. 4
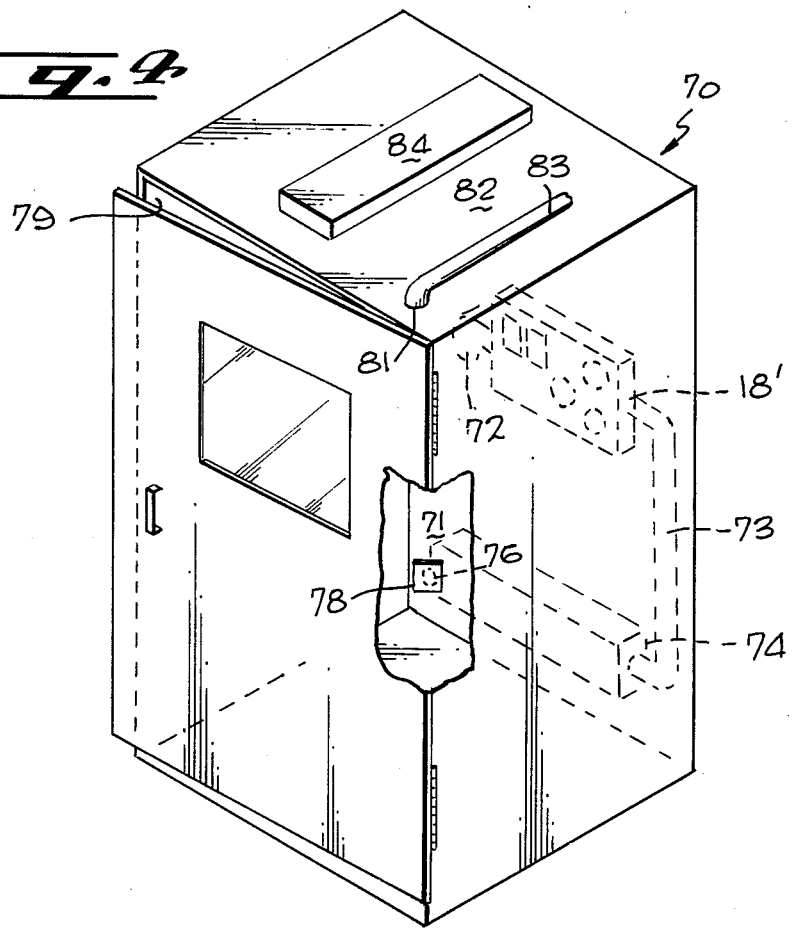
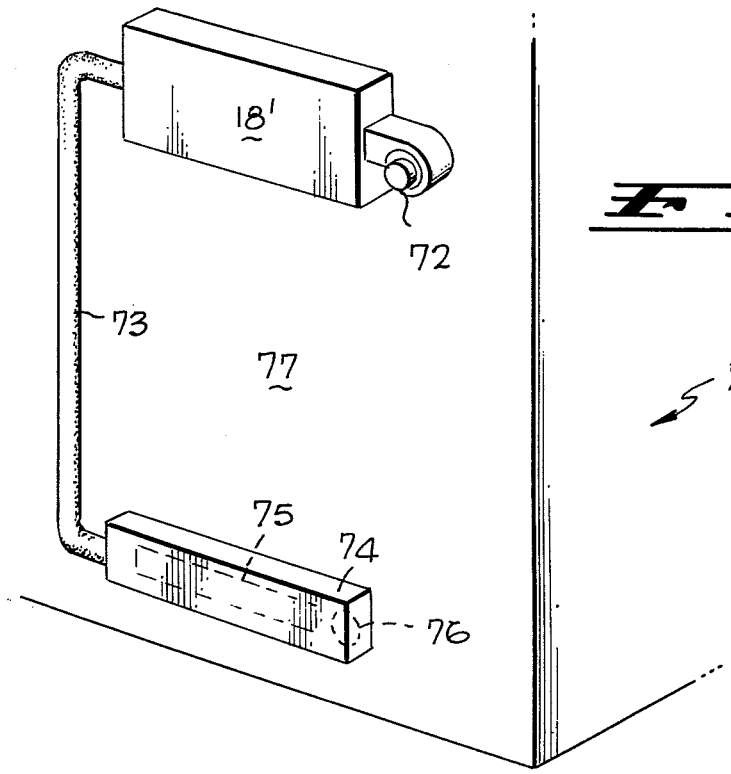
Fig. 5

APPARATUS FOR CARDIOVASCULAR CONDITIONING AND OTHER PHYSIOLOGICAL PURPOSES

BACKGROUND OF THE INVENTION

1. Field of the Invention

The present invention relates to a physiological device particularly useful as a cardiovascular exerciser, as a substitute for an artificial kidney and as a means for improving the condition of various other tissues and organs. More particularly, the invention relates to such a device wherein elevated environmental temperature promotes profuse perspiration of a person seated or lying in a chamber, and wherein very low humidity air blown through the chamber causes rapid evaporation of the sweat. To remove the sweat from the body at very high sweating rates a variable speed fan is used with the speed adjusted to circulate the air in the chamber at a sufficiently high rate to remove the perspiration as rapidly as it is formed. This profuse sweating and rapid evaporation causes the heart to beat faster, thereby producing controlled cardiovascular conditioning. Since the sweat composition is approximately the same as that of blood plasma, a kidney function may be accomplished by exposing a person in the chamber to a sufficiently high temperature. Adjustments in diet can be made to produce a sweat excretion which will remove the waste products as effectively as the kidneys.

2. Description of the Prior Art

Improved cardiovascular conditioning is fundamental both to good health and to counteract the deterioration of the cardiovascular system resulting from the aging process.

To function properly, all human body cells must receive certain requisite inputs including nutrients, oxygen, neural signals and the like. In the presence of the correct input mix, the cells not only perform their specialized physiological functions, but also function to tear down and resynthesize themselves. That is, the body cells are actually replaced over a period of time as part of a "restructuring cycle". If the requisite inputs are not provided to the cells in proper quantity, or if harmful inputs such as pathogens, various drugs and chemicals, ultraviolet light, injuries, etc., are present, cellular function is impaired and the restructuring cycle may be adversely affected.

Health improvement requires both that the correct cellular inputs be present and that they be delivered efficiently to the cells, primarily by the cardiovascular system. Comprehensive arterial and venous blood anaylsis can be performed to ascertain the levels of requisite cellular inputs such as $O_2$, $CO_2$, $NH_3$, urea, uric acid, the nine essential amino acids, the essential fatty acids, phospholipids, cholesterol, cholesterol esters, all of the vitamins, the thirteen or so essential cations, the half dozen anions, all of the hormones, the various messenger and recognition molecules, the osmotic pressure, the pH and ionic strength. Specific inadequacies can be determined, and where appropriate, these can be supplemented by dietary changes, vitamins and minerals, etc. Similarly, harmful inputs can be eliminated, as by dietary correction, environmental changes and so forth.

However, even with the correct input mix, optimal cellular functioning will not be achieved unless there is an adequate rate of delivery to the cells via the cardiovascular system. Not only does the cardiovascular system serve as a delivery and removal system for the cells, but it also provides heat exchange, water balance, self-protect and communications functions. The cells are in trouble if there is a poor rate of delivery because of lowered blood flow rates through the capillary bed. Good health requires an efficiently operating cardiovascular system.

The aging process probably is directly related to the restructuring cycle. Given the proper input mix and efficient delivery via the cardiovascular system, cellular restructuring should maintain the human body in good healthy condition indefinitely, without cellular deterioration. However, the aging process which appears at the onset of maturity probably undermines the restructuring cycle, so that cycle by cycle, the cell's components may become increasingly defective. It may be that after a genetically predetermined number of cycles, cellular function diminishes to a point where the restructuring cycle cannot be maintained and the cell dies. A person's potential life span thus may be genetically determined by the number of cellular cycles required to convert the healthy cells of early adulthood into deteriorated, inefficient cells. This could be the aging clock.

Superimposed on this type of gradual deterioration, are the effects of improper input mix and any harmful inputs that interfere with the restructuring cycle by damaging or destroying cellular components. If there has been no extensive damage to cell or tissue morphology, when harmful inputs are removed, the cells naturally tend to improve the condition of their components, restoring the level of cellular and tissue morphological and functional competence that is characteristic of the restructuring cycle status of the individual's physiological age. Thus when heavy smokers give up smoking, within a year, the lung tissues have largely overcome the detrimental effects of years of smoking. Similarly, the blood dyscrasias of the survivors of Hiroshima have almost all disappeared.

The effects of the aging process are accelerated by a degenerative feedback loop that increases the rate of cellular deterioration. With increasing age, the restructuring cycle is undermined and a certain portion of the body's cells become inefficient or die. For example, by age 70 the kidneys and liver may have lost 40 percent of their cells. As a result, the demand for nutrient delivery is reduced. Having to serve a smaller cellular mass, the cardiovascular system undergoes a gradual, compensatory hypotrophy which is superimposed on the aging induced cardiovascular deterioration.

Thus the feedback loop is:

a. less and poorer functioning body cells;
b. lowered blood flow demand;
c. cardiovascular cellular atrophy;
d. lower cardiovascular output;
e. further net cell loss and poorer body cells; and
f. further decrement in cardiovascular condition.

This feedback gradually increases and in time reaches a point at which the body's cells rapidly begin to fail, resulting finally in a terminal condition.

In should be possible to break into this feedback loop and in many cases reverse the cardiovascular cellular hypotrophy by a program of gradually increasing demand on the cardiovascular system. Such increased demand over a period of time should improve the cardiovascular system, significantly increasing the rate of capillary blood flow, and reducing the resting pulse rate and blood pressure level. As a consequence of such improvement in the cardiovascular system, body cell morphology and function should be improved. Not only should this promote good health, but it should also result in a gradual improvement in many degenerative conditions in which rate of capillary blood flow is a significant factor. The restructuring cycle should be improved, with a probably reversal of net cellular loss, i.e., a gain in the cellular population of the liver, kidneys and other organs. A slowing of the deteriorative effects of the aging process may be achieved.

Certain of these benefits of improved cardiovascular conditioning have been recognized in the past. The widely used conditioning program known as "aerobics" accomplishes cardiovascular conditioning by a program of physical exercise primarily involving the lower limbs. A daily regimen of running-in-place, jogging or cycling places an increased demand on the heart and vascular system. The exercises are performed in a sufficiently rigorous manner so as to raise the pulse rate substantially. By placing this daily, short term high demand on the heart, researchers in exercise physiology have found that the performance of the cardiovascular system is significantly improved. Over a long term, the capillary blood flow rate is increased, the resting pulse rate is decreased, and the general condition of the cardiovascular system is improved.

Certain shortcomings are inherent in the use of physical exercise programs such as aerobics to achieve cardiovascular conditioning. The principal shortcoming is that toxic waste products formed by the exercised muscle cells are fed back into the bloodstream. These include lactic acid, ammonia, urea, creatinine and others. For a relatively young person, such waste products are easily removed. However, for persons over 40 or 50 years of age, the body may not be able to eliminate or cope with these waste products rapidly after the intense exercise period. Detrimental side effects may occur. Moreover, daily rigorous physical exercise is not possible for seriously disabled persons with many types of infirmities and for people of advanced age.

A principal object of the present invention is to provide an apparatus and method for conditioning the cardiovascular system without resort to muscular exercise. Another object is to provide a heart exerciser in which profuse sweating is used as the means for creating a gradually increasing demand on the cardiovascular system. Further objects include providing a heart exerciser wherein (a) the user experiences no discomfort during the heart exercise period; (b) the user may sit or recline in a chamber during the cardiovascular conditioning program; (c) the amount of pulse rate elevation may be controlled to obtain gradually increasing cardiac demand; and (d) even persons with impaired physical health may obtain improved cardiovascular conditioning without any physical exertion. Use of the inventive cardiovascular conditioning system should lead to improved cell nutrient input delivery, with a concomitant interruption of the cellular deterioration feedback loop.

Yet another object of the present invention is to provide a device wherein profuse sweating accompanied by rapid evaporation of the perspiration is used for beneficial physiological effects. Such effects include, but are not limited to the heart exercise functions described above. Another use of the device is as a substitute for the artificial kidney. This function is achieved since the composition of sweat is quite similar to blood plasma. Both contain urea, uric acid, creatinine and minerals such as sodium, calcium, phosphate and iodine. The sweat glands function as secondary excretory organs. By remaining in the device chamber for say 2 hours each morning and 2 hours each afternoon or evening, conditions can be established in the inventive system to produce the elimination of 10 liters or more of sweat. The total amount of sweat lost is readily determined because the water from the evaporated sweat is recovered in a water condensation and collection system. By collecting a portion of the sweat in a bed pan, the precise mineral and vitamin composition can be determined. To prevent any depletion of these substances in the blood the patient, while in the chamber, takes at intervals enough capsules which contain these substances to replace the anticipated losses in the perspiration. He also drinks at intervals enough fluid to replace his water loss. Thus, in spite of the large mineral and water losses during his stay in the chamber, his body remains in water and mineral balance. Like the kidneys, the sweat glands do not excrete appreciable amounts of the vital nutrients, glucose and the amino acids, nor do they excrete any of the plasma proteins. Compensation for variations in the excretion of any of the minerals is made by adjusting the mineral composition of the capsules. Particularly when combined with a low protein diet to minimize urea production, this is sufficient to rid the body of those daily waste products which in a healthy person would be eliminated by the properly functioning kidneys.

Use of the present invention as a kidney substitute is particularly advantageous since it is quite comfortable to the user. It requires no invasion of the blood vessels as is required by kidney dialysis machines and need not interfere with a person's normal routine of living. The person merely sits in a chamber. Although sweating profusely as a result of elevated environmental temperature, the perspiration is very rapidly evaporated, so that the user feels no discomfort. He can read, watch television, converse or otherwise occupy himself.

The present invention also may be useful in the treatment of gout, and for drug and alcohol detoxification since uric acid and ingested drugs and alcohol are also eliminated by the eccrine sweat glands. Beneficial effects to the skin and lungs are anticipated because of the high blood circulation through these tissues during the use of the inventive system.

SUMMARY OF THE INVENTION

These and other objectives are achieved by the present invention wherein profuse sweating and rapid evaporation of the perspiration are used to accomplish cardiovascular conditioning and/or bodily waste product elimination.

The inventive process incorporates the following sequence:

1. hot, low humidity air is blown over all of the body surfaces; alternatively the air may be both passed over and circulated rapidly over all the body surfaces;
2. resultantly, an elevated temperature input is sensed by the heat sensors in the skin;
3. hypothalamic stimulation is produced; causing
4. increased rate of heart and arterial tree contraction and reduced arteriolar tension; with concomitant
5. greater blood flow in the eccrine glands and in the bronchi and the alveoli of the lungs;
6. profuse sweating occurs as well as increased expiration of water;
7. rapid sweat evaporation takes place owing to the low humidity air being circulated;

8. body heat is lost through skin cooling and the heat content of the expired moisture; which results in
9. blood cooling; and
10. maintenance of approximately normal body temperature.

This process advantageously is accomplished using an apparatus in accordance with the present invention, and having a chamber within which the person is situated. A source of hot, dry air is supplied to the chamber. Typically the humidity is on the order of 10 percent or less. The air temperature is adjusted to produce the desired pulse rate elevation in the person using the system.

In one embodiment of the invention a fan, situated in a recess opening into the chamber, circulates the hot, dry air at a very fast rate. The air flow over the body may be varied from 0 to more than 50 miles per hour. Such rapidly circulated, low humidity air causes rapid evaporation of perspiration. The resultant moisture-laden air is exhausted from the chamber into an evaporator where it is rapidly cooled. The accumulated, condensed sweat and expired moisture is collected in a container, thereby enabling determination of the amount of perspiration and expired moisture that have been produced. The same air then is reheated, mixed with sufficient fresh air to bring the oxygen level up to a normal level, and recirculated back to the chamber. A vent in the chamber prevents air pressure build up in the chamber, and provides a release for expired $CO_2$.

A control panel mounted within the chamber includes indicators for the relative humidity and temperature of the air, and includes adjustments for the air temperature and air flow rate. Additional monitors are provided to indicate the heart rate and body temperature of the person using the device.

BRIEF DESCRIPTION OF THE DRAWINGS

A detailed description of the invention will be made with reference to the accompanying drawings wherein like numerals designate corresponding parts in the several figures.

FIGS. 4 and 5 are front and rear pictorial views of an alternative embodiment of the invention which does not employ independent dehumidification equipment and fan.

DESCRIPTION OF THE PREFERRED EMBODIMENTS

The following detailed description is of the best presently contemplated modes of carrying out the invention. This description is not to be taken in a limiting sense, but is made merely for the purpose of illustrating the general principles of the invention since the scope of the invention is best defined by the appended claims.

Operational characteristics attributed to forms of the invention first described also shall be attributed to forms later described, unless such characteristics obviously are inapplicable or unless specific exception is made.

Figure 1:
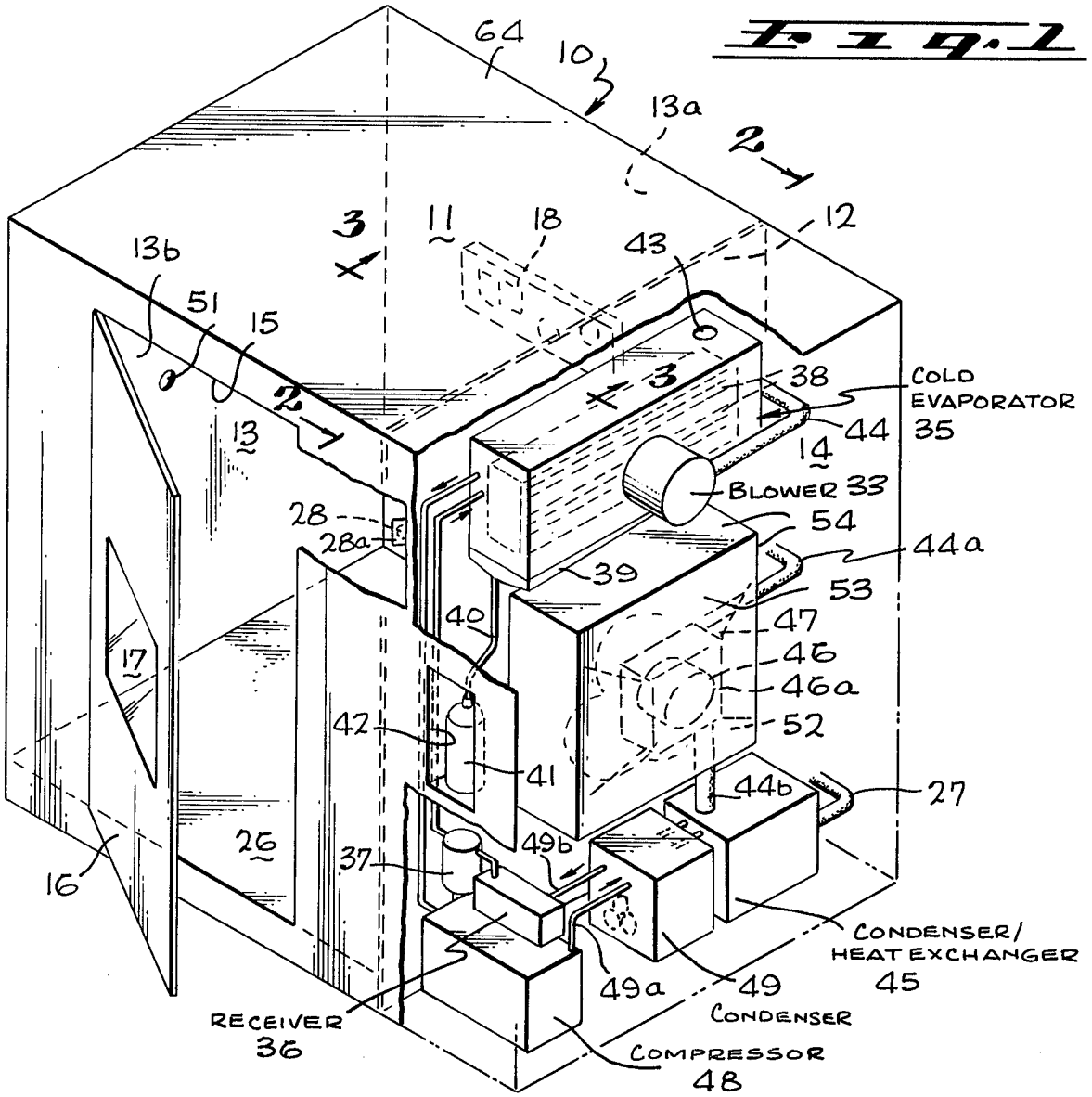
FIG. 1 is a pictorial view of a physiological apparatus in accordance with the present invention. The view is partly broken away to show the equipment used to heat, dehumidify and circulate the air that is used to stimulate profuse sweating and to accomplish rapid evaporation of perspiration of a person seated within the apparatus chamber.
Figure 2:
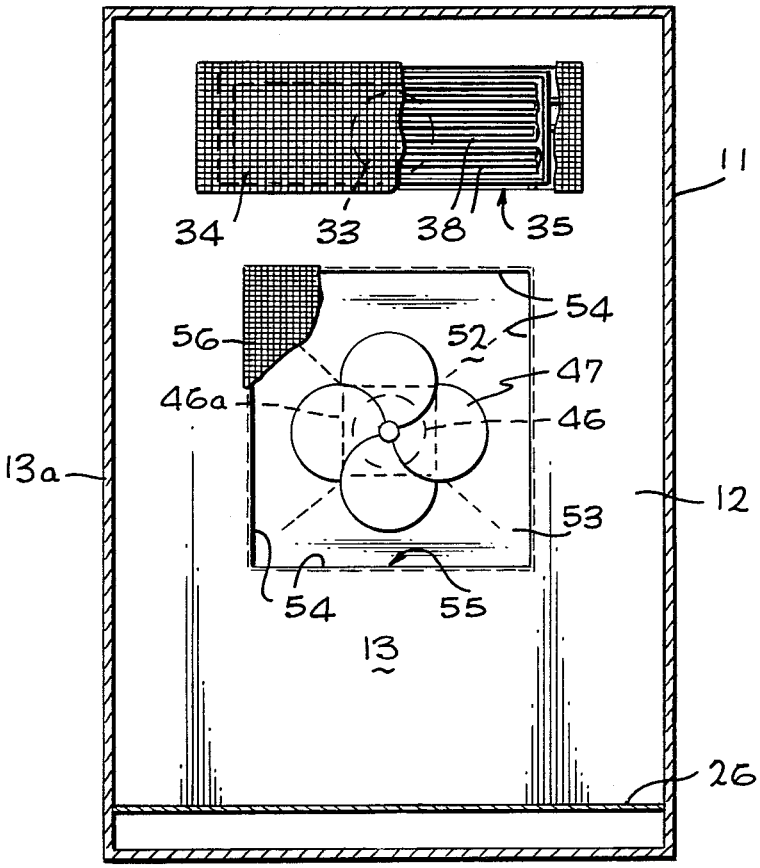
FIG. 2 is a pictorial view of the chamber interior wall, as viewed along the line 2—2 of FIG. 1, showing the fan and recessed cavity arrangement used to achieve rapid circulation of air in the chamber.
Figure 3:
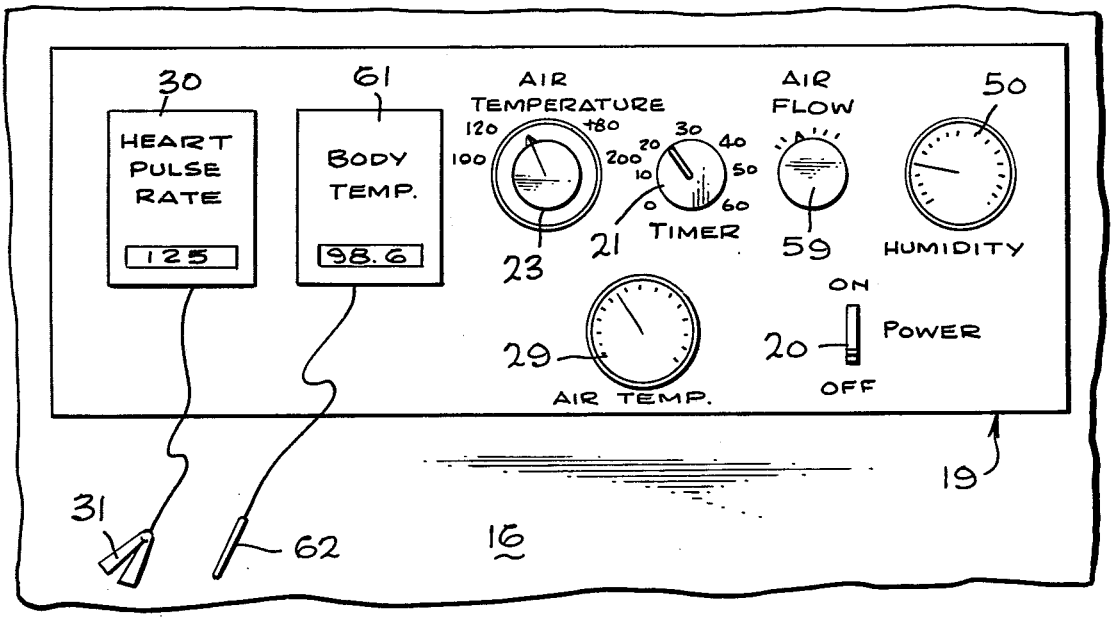
FIG. 3 is a pictorial view of the control panel situated on the interior back wall of the apparatus of FIG. 1, as seen along the line 3—3 thereof.

Referring now to FIGS. 1 through 3, the inventive physiological apparatus 10 includes a housing 11 having a partition wall 12 that separates a chamber 13 from an equipment compartment 14. The chamber 13 is of sufficient size to house a person seated on a chair (not shown) and to allow easy entrance via a doorway 15. Typically, the inside dimensions of the chamber 13 may be 46 inches wide, 30.5 deep and 75 inches high, so as to have a volume of 61 cubic feet. A hinged door 16 encloses the chamber 13 during use, and has a window 17 permitting visual communication and preventing a shut-in feeling by the user. Walls, door, ceiling and floor of chamber 13 are all heat insulated.

Figure 1A:
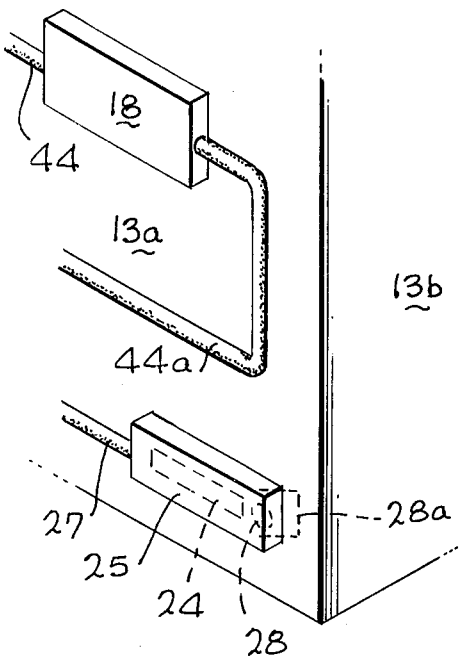
FIG. 1A is a pictorial view of a portion of the rear of the apparatus of FIG. 1.

Mounted on the rear wall **13*a* of the chamber 13 (FIG. 1A) is a control box or instrument cabinet 18 containing the operational controls for the apparatus 10. These are situated on a control panel 19 (FIG. 3) on the inside of the chamber 13. The controls include a power switch 20 to turn on the power to all of the system components, and a timer 21** which establishes the length of time that the apparatus is used.

When used as a cardiovascular exerciser, a person enters the chamber 13, turns on the power switch 20, selects the exercise time duration of the timer 21, and sets the desired air temperature by means of a thermostatic control 23. This control 23 energizes a heating element 24 situated in a metal housing 25 mounted in the lower back all 13a of the chamber 13. Low humidity air supplied to the housing 25 via a duct 27 flows over the heating element 24 and through an opening 28 in the lower back wall **13*a* into the chamber 13. This heats the chamber 13 to the temperature established by the thermostatic control 23. A metal deflector 28*a* in front of the opening 28 may deflect the incoming hot air toward the chamber side wall 13*b*. The air temperature also is indicated by a thermometer 29.**

Heat sensors in the skin of the user respond to the elevated temperature in the chamber 13, producing hypothalamic stimulation that causes an increase in the heart pulse rate of the user. This pulse rate advantageously is monitored by a meter 30 (FIG. 3) having a sensor 31 that may be attached to a finger of the user.

Profuse sweating occurs. The increased heart rate, arterial tree contractions and reduced arteriolar tension all contribute to the greater blood flow supplying the necessary fluid to the eccrine glands which produce the perspiration.

Rapid sweat evaporation takes place as a result of the high flow rate circulation of very low humidity air in the chamber 13. To this end, a blower 33 (FIG. 1) exhausts air from the chamber 13 via a grille 34 (FIG. 2) and a cold evaporator 35. A coolant such as Freon, supplied in a known manner via a receiver 36 and an expansion valve 37, flows through the coils 38 in the evaporator 35. The low temperature of the coils 38, typically just a few degrees above freezing, causes condensation of the moisture carried by the air flowing from the chamber 13. The condensed water flows from a pan 39 at the bottom of the evaporator 35 via a hose 40 into a graduated collection bottle 41 situated in a recess 42 in the front of the housing 11.

The air sucked in by the blower 33 is recirculated back to the chamber 13. A small opening 43 is provided in the housing of the evaporator 35 to admit fresh air that is mixed with the air sucked from the chamber 13 to replenish the oxygen absorbed by the user. A fluorescent light (not shown) illuminates the chamber 13.

From the blower 33, the air is directed via a duct 44 through the instrument cabinet 18 (FIG. 1A), thereby cooling the controls and equipment mounted inside the cabinet 18 and absorbing the heat passing through the control panel 19 from the chamber 13. Since the air coming from the instrument cabinet 18 still is relatively cool, it is used advantageously to cool the motor 46 that drives a fan 47 (FIG. 2) which faces the chamber 13. To this end, the duct **44*a* enters an insulated housing 44*a* that encloses the motor 46. The air, now further warmed from the heat absorbed from the fan motor 46, passes from the motor housing 46*a* via a duct 44*b* into a condenser/heat exchanger 45. The coil of the condenser 45 is connected in series with a fan cooled condenser 49 associated with the compressor 48 of the refrigerating unit. Thus the air is further heated before it is led by duct 27 into the heater chamber 25. In this way an appreciable fraction of the heat extracted from the air in the evaporator 35 is returned to the air via the condenser 45.**

The condenser/heat exchanger 45 is connected via the lines **49*a*, 49*b* to the fan cooled condenser 49 which is in the coolant path between the compressor 48 and the receiver 36. The coolant (Freon) emerges from the compressor 48 as a pressurized vapor at elevated temperature. The Freon is pre-cooled in the fan cooled condenser 49 and further cooled in the condenser 45 by heat exchange to the air flowing to the duct 27. Advantageously the evaporator 35 and the compressor 48 are adjusted so that the return air supplied via the duct 27 is of very low humidity, typically on the order of 10 percent or less. The relative humidity level in the chamber 13 is indicated by a relative humidity gauge 50 on the control panel 19.**

The air flow rate through the evaporator 35 and the blower 33 typically is set to change the air in the chamber 13 every 2 minutes. Thus for the illustrative chamber dimensions set forth above, a flow rate of about 30 cubic feet per minute will provide a complete change of air every 2 minutes. A small vent opening 51 is provided in the chamber 13 wall to permit escape of an amount of air equal to that admitted by the opening 43 in the evaporator 35 housing. This insures that there is no pressure build up within the chamber 13, and also provides a path for the escape of exhaled carbon dioxide.

To insure rapid evaporation of perspiration when perspiration rates are very high, it is necessary to have the low humidity air in the chamber 13 flow very rapidly over the surface of the user. This is accomplished by means of the fan 47 which is situated in a large recess 52 (FIG. 2) that projects into the equipment compartment 14, but which is open to the chamber 13. The recess 52 has a closed rear wall 53. The side, top and bottom walls 54 are solid and like the rear wall 53 are all heat insulated so that the recess 52 forms an extension of the chamber 13, communicating therewith through the large opening 55 in the partition wall 12. A protective grille 56 covers all of the opening 55.

The speed of the fan motor 46, and hence the rate at which the fan 47 recirculates air within the chamber 13, is controlled by a conventional motor speed control 59 mounted on the panel 19 (FIG. 3). Typically the recess opening 55 may be 3 feet high and 28 inches wide, with a fan 47 blade diameter on the order of 20 inches. With these dimensions, a large volume of air will enter the recess 52 around the sides, top and bottom of the fan 47 and will be blown from behind the fan 47 outward toward the user seated in the chamber 13. An air speed in front of the fan 47 of 50 miles per hour or more can be readily obtained, but the particular speed is not critical, so long as it is sufficiently great to insure rapid sweat evaporation.

As a result of the rapid evaporation of perspiration, the user remains "dry" and feels quite comfortable, even though the heart rate is elevated and profuse sweating is taking place. The body is cooled by the heat absorbed through the evaporation of the sweat. This results in maintenance of near normal internal body temperature despite the very high environmental temperature in the chamber 13. The user's body temperature may be monitored on a temperature gauge 61 mounted on the panel 19 and having an associated oral or rectal sensor 62.

Advantageously, the interior of the door 16, the ceiling 64, the petition 12, the side wall **13*b* and the back wall 13*a* of the chamber 11 all are fabricated of sheet aluminum. The walls and ceiling advantageously are interconnected by aluminum angle. This design ensures rapid heat equilibrium of the chamber interior walls because of the high heat conductivity of aluminum. A person in the chamber 13 is exposed to a uniform heat radiation from all the chamber interior surfaces, with the exception of the floor which advantageously is wooden to inhibit heating and to permit comfortable contact with the person's feet. The heat capacity of the housing 11** is kept very low by using lightweight construction, together with insulation material (not shown) of either fiberglass or polyurethane.

With this construction, the chamber 13 can reach temperatures of up to 150° F in about 10 minutes, and can reach temperatures of about 170° F in an additional 10 to 15 minutes. This is achieved through use of a heating element 24 having a high heat delivery rate (typically, a 3500 watt heating element may be used), coupled with the features of high air flow rate through the chamber 13, low chamber 13 heat capacity, and rapid air circulation within the chamber 13 by means of the fan 47.

The cardiovascular exercise regimen employing the inventive apparatus 10 is individually established for each user. Typically, for the first 2 weeks the user will adjust the air temperature using the thermostatic control 23 to a level that produces a mild increase in heart rate, say to 90 or 100 beats per minute as indicated by the monitor 30. The user remains in the chamber 13 for a half hour period each day, which time may be set on the timer 21. Over a period of months, the user gradually increases the air temperature, so that his heart rate during the exercise period also gradually is increased. After some months, a considerably elevated pulse rate during exercise will be achieved. Typically, the pulse rate than may be 135 or more beats per minute, and the exercise period may be extended and the chamber may be used more than once per day. Thereafter, this same level of pulse rate elevation and exercise timer duration may be continued on a daily basis, to achieve continuing, optimal cardiovascular exercise.

It is important that the user gradually build up to this optimal exercise level. If the user too early in the exercise program sets the chamber temperature or exercise period at a level greater than his bodily capability, this may be indicated by abnormal fluctuation in the heart pulse rate or by a feeling of discomfort or an increase in the body temperature as indicated by the monitor 61. Should these counterindications be present, the air temperature should be reduced and/or the exercise period shortened or terminated. Appropriate alarm mechanisms, known per se, may be associated with the heart pulse rate indicator 30 and the body temperature indicator 61 to sound an alarm, to terminate operation of the apparatus 10 and/or automatically to open the door 16 should either of these events occur.

The chamber 13 dimensions set forth hereinabove are exemplary only. Larger or smaller chamber sizes may be employed. For example, the present invention may be utilized for bedridden patients, and to that end the chamber 13 may be dimensioned to receive a hospital bed on which the patient lies or reclines during use of the apparatus 10.

The humidity level of the air recirculated through the chamber 13, and the rate at which this air is blown across the user's body by the fan 47 are not critical. However, the humidity should be sufficiently low, and the circulation speed sufficiently great so that the perspiration is evaporated sufficiently fast to maintain the body temperature at its normal level, and so that the user remains comfortable while using the apparatus 10.

Accumulation of the evaporated perspiration in the bottle 41 affords a measure of the amount of water and minerals which have been lost by the user during the heart exercise period. Since the composition of perspiration is known, the user can then replenish the lost minerals by an appropriate dietary supplement taken during or after completing his heart exercise regimen. These minerals include the minerals of the blood plasma. An appropriate mix of these minerals may be prepared, and taken by the user in an amount corresponding to the amount lost in the perspiration.

The composition of sweat not only includes the minerals listed above, but also includes urea, creatinine and uric acid. This being so, the eccrine glands act as secondary excretory organs, and permit the inventive physiological apparatus 10 to be used in place of a conventional aritifical kidney for bodily waste removal in a person having impaired kidney function. To this end, the patient uses the apparatus 10 in a manner similar to that described above, but for a longer period of time appropriate to eliminate via perspiration the bodily waste products which cannot otherwise be eliminated because of the impaired kidney function. For example, the patient may remain in the chamber 13 for a period of say 2 hours each morning and 2 hours each afternoon, during which time typically 10 liters of perspiration will be evaporated. Particularly when combined with a low protein diet to minimize urea production, such sweat removal of urea and other bodily waste products will be sufficient to substitute for the impaired kidney function.

Similarly, the inventive apparatus 10 may be used for the treatment of gout, which also involves uric acid build up in the body. Moreover, the waste removal capability of the present invention is potentially useful for alcohol and drug detoxification purposes.

A simplified embodiment of the invention is shown in FIGS. 4 and 5. There, the apparatus 70 consists of a chamber 71 that may be configured and dimensioned like the chamber 11 (FIG. 1), without the attached fan chamber, dehumidification equipment and perspiration collection system.

Room air is blown through the instrument cabinet 18' (FIG. 5) by a blower 72 which typically delivers air at about 100 cubic feet per minute. This air, preheated in the instrument cabinet 18', is supplied via a duct 73 to a housing 74 which contains one or more heating elements 75. The heated air enters the interior of the chamber 71 via an opening 76 from the housing 74 through the rear wall 77. A deflector 78 directs this heated air against a side wall 79 of the chamber 71. Air is vented from the chamber 71 via an opening 81 in the ceiling 82 located diagonally across from the entry hole 76. An outlet duct 83 may be provided from the air outlet opening 81 to conduct exhausted air out of the room of building in which the apparatus 70 is situated. A fluorescent lamp 84 lights the chamber 71.

The blower 72 delivers air at a sufficiently high rate to remove perspiration from the user. Since the incoming room air first is rapidly heated by the heating element 75, the resultant relative humidity of the air supplied to the chamber 71 is low. Since the air quickly passes out of the chamber via the outlet 81, the air flow rate provided by the blower 72 is adequate to maintain this low relative humidity level obtained by heating the room air. Typically, the heating element 75 may comprise two 1800 watt elements mounted serially in the compartment 74. To permit operation without special wiring, each of these heating elements may be connected to separate wall outlets supplied by separate lines each having 15 ampere fuses or circuit breakers.

Construction of the chamber 71 advantageously is like that of the chamber 11. This permits modular construction, so that an equipment compartment 14 (FIG. 1) and its associated dehumidification equipment may be added to the apparatus 70 (FIG. 4) by substituting the compartment 14 for one of the chamber 71 side walls.

In applications where it is necessary to obtain accurate measurement of the amount of perspiration, it is desirable initially to flood the interior of the cold evaporator 35 with water. This ensures that any additional condensed moisture (i.e., recovered perspiration) will drain into the collection bottle 41, and will not remain trapped within the evaporator 35. Such pre-flooding can be accomplished by means of a water supply tank and a pump (not shown) which are connected to fill the evaporator 35 full of water prior to the initial accumulation of perspiration. Once the evaporator 35 has been flooded, the water supply tank and pump are disconnected and evaporation of perspiration is initiated. Any perspiration that condenses in the evaporator 35 will immediately drain into the bottle 41, since the evaporator 35 already contains the maximum amount of water. Accurate measurement of the recovered perspiration thus is facilitated. A two-way valve (not shown) may be provided in the line 40 to connect the drain of the evaporator 35 back to the water supply tank prior to accumulation of perspiration, and to connect the line 40 to the bottle 41 when collection is initiated.

Intending to claim all novel, useful and unobvious features shown or described, the inventor makes the following claims:

1. A physiological apparatus useful for cardiovascular conditioning and other physiological purposes, comprising:

a chamber, heater means for introducing heated air into said chamber at a controlled, elevated temperature to promote profuse perspiration of a nude person in said chamber, and evaporation means for circulating said introduced heated air over said person in said chamber at a flow rate sufficient to achieve continued rapid evaporation of said perspiration and of moisture expired by said person, and for continuously, rapidly removing from said chamber air containing evaporated perspiration and expired moisture.

2. A physiological apparatus according to claim 1 wherein said introduced air is provided to said chamber at a low humidity, and fan means for rapidly circulating said low humidity heated air within said chamber over the body of said person.

3. A physiological apparatus according to claim 2 wherein said provided low humidity air has a relative humidity of less than about 20 percent, and wherein said fan means comprises a fan of adjustable speed situated in direct communication with said chamber.

4. A physiological apparatus according to claim 1 wherein said evaporation means comprises:

an evaporator, exhaust blower means for exhausting perspiration-laden air from said chamber via said evaporator, said perspiration condensing out from said exhausted air in said evaporator, and collection means for collecting the perspiration condensed in said evaporator.

5. A physiological apparatus according to claim 4 further comprising:

means for returning said dehumidified air from said evaporator to said chamber, said heater means heating said returned air, and including means for replenishing oxygen to and exhausting carbon dioxide from said returned air.

6. A physiological apparatus according to claim 4 wherein said evaporation means further comprises:

a coolant system including a compressor, connected to provide a coolant to said evaporator, and wherein said collection means comprises a bottle.

7. A physiological apparatus according to claim 2 wherein said fan means comprises a fan situated in a recess communicating to said chamber via an opening, said recess and opening being larger than said fan so as to provide a flow path for air from said chamber around said fan to the space therebehind, said fan being pointed so as to blow air from said space toward said chamber.

8. A physiological apparatus according to claim 2 wherein said evaporation means removes from and provides to said chamber a volume of air equal to the chamber volume at least every three minutes.

9. A physiological apparatus according to claim 1 further comprising a control panel in said chamber including:

a temperature control for said heater means and adjustable by said person to obtain an air temperature sufficiently high so as to cause increased heart pulse rate of said person, a heart rate monitor for indicating said increased heart rate of said person, and an air flow control, cooperating with said evaporation means, for controlling the circulation of said low humidity air in said chamber to a rate sufficient to achieve rapid evaporation of perspiration from said person.

10. A process for cardiovascular conditioning utilizing the physiological apparatus according to claim 9, comprising:

placing a person in the chamber of said apparatus and connecting said heart rate monitor to said person, adjusting said temperature control to cause heating of the air in said chamber to a level that results in an elevated heart pulse rate in said person as indicated by said monitor, adjusting said air flow control to achieve rapid evaporation of perspiration from said person so that there is no appreciable elevation of the internal body temperature of said person, and maintaining said conditions of heat level and air flow rate for a sufficiently long duration to provide prolonged exercise to the cardiovascular system of said person.

11. An apparatus useful for cardiovascular conditioning, bodily waste elimination, and other physiological purposes, comprising:

a chamber dimensioned to hold a person, a temperature controlled heater for heating the air in said chamber to a temperature adjustable up to a temperature sufficient to cause profuse perspiration of a person in said chamber, an air dehumidifying system for exhausting and condensing the waste from the perspiration-laden air from said chamber, and a fan situated to create a current of said low humidity air within said chamber sufficient to assist in the removal of perspiration from the skin of said person.

12. An apparatus according to claim 11 wherein said dehumidifying system includes:

an evaporator, a blower for exhausting perspiration-laden air from said chamber via said evaporator, and collector means cooperating with said evaporator for collecting the water, derived from evaporated perspiration, which condenses in said evaporation.

13. A system for cardiovascular conditioning using an apparatus according to claim 12, comprising:

placing a person in said chamber, adjusting said heater to achieve a chamber air temperature sufficient to cause said person's heart rate to become elevated, thereby exercising the person's heart, adjusting said fan speed to obtain an air current sufficient to cause said person's perspiration rapidly to evaporate, collecting and measuring the evaporated perspiration condensed in said evaporator, continuing said heart exercise for a selected time duration, and replenishing by dietary supplement to said person the same quantity of minerals that would be contained in the perspiration from which said collected and measured water is derived.

14. A system for removal of bodily waste in the blood plasma using an apparatus according to claim 12, comprising:

periodically placing in said chamber a person having impaired or no kidney function, adjusting said heater to achieve a chamber air temperature sufficient to cause said person to perspire profusely, adjusting said fan speed to obtain an air current sufficient to cause said person's evaporated perspiration to be rapidly removed from the person's skin, collecting and measuring the water derived from the perspiration condensed in said collector means, and continuing said perspiration and perspiration evaporation for a sufficiently long time duration so that the urea, creatinine, uric acid and other waste product contents of said perspiration correspond to the normal kidney output for the time duration between periodic sessions in said chamber.

15. A process for physiological conditioning of a person, comprising:

a. subjecting said person to an environmental temperature elevated to a level that promotes profuse perspiration of said person, b. circulating low humidity air over said person's body at a sufficient flow rate to accomplish rapid evaporation and continued removal of said perspiration without appreciable increase in the person's internal body temperature, and c. continuing said (a) subjecting and (b) circulating steps for a sufficient time duration to achieve physiological benefit.

16. A process according to claim 15 utilized for cardiovascular conditioning, comprising the further step of:

d. monitoring the heart rate of said person while subjected to said elevated environmental temperature, said elevated environmental temperature being set to a level that results in an elevated heart rate, and repeating said (a) – (d) steps over a prolonged time period with gradually increasing environmental temperature levels to achieve cardiovascular exercise at concomitantly gradually increasing heart rates.

17. A process according to claim 15 utilized for bodily waste elimination to assist a kidney having impaired function, comprising the further step of:

e. collecting by condensation from said circulated air the water from the perspiration evaporated from said person, and f. measuring the amount of water, derived from perspiration, collected during said step (c) time duration, and repeating said steps (a), (b), (c), (e) and (f) at sufficient intervals so that the measured amount of evaporated and collected perspiration at each such repetition contains an amount of urea, creatinine, uric acid and other waste products in the blood plasma commensurate with that eliminated from the body by an operative kidney in a like between-repetition time interval.

18. A physiological apparatus according to claim 1 wherein said chamber interior has thin metal walls together with heat insulation exterior of said metal walls, said chamber exhibiting rapid heat equilibrium and low heat capacity.

19. A physiological apparatus according to claim 1 wherein said evaporation means is housed in a separate equipment chamber removably attached to said chamber.

20. A physiological apparatus according to claim 1 wherein said evaporation means includes:

a blower for blowing room air through said heater means into said chamber via an inlet, the resultant heating causing the relative humidity of said room air to drop to a low level, and an outlet for exhausting air from said chamber.

21. A physiological apparatus according to claim 20 wherein said inlet is on one wall of said chamber, and wherein said outlet is on an opposite wall of said chamber.

22. A physiological apparatus according to claim 4 further comprising:

pre-flooding means for saturating said evaporator with water prior to collection of perspiration by said collection means, said saturation insuring that all condensed perspiration will be collected with no initial accumulation of condensed perspiration in said evaporator.

23. A physiological apparatus for cardiovascular conditioning, bodily waste elimination, and other physiological purposes, comprising:

a chamber dimensioned to hold a person, and first means for circulating heated, low humidity air into and then out of said chamber, the temperature of said heated air being sufficient to cause said person to perspire, said low humidity air producing continued evaporation and removal of the perspiration and expired moisture of said person.

24. A physiological apparatus according to claim 23 further comprising:

second means for blowing the air within said chamber around the body of said person further to accelerate the removal of said evaporated perspiration and expired moisture.

25. A physiological apparatus according to claim 23 wherein said first means comprises:

a heating element, a blower for blowing room air over said heating element and into said chamber, and an outlet opening to permit exhaust of air from said chamber, the rate of said blower and the heating capacity of said element causing said room air to be heated to a temperature sufficient to cause perspiration and to drop the relative humidity to a level sufficient to produce said evaporation and removal of perspiration.

26. A physiological apparatus according to claim 25 wherein said first means comprises:

a closed recirculation path exiting from said chamber and leading back to said chamber, said recirculation path including:

means for exhausting air from said chamber, through said path, and back into said chamber, and an evaporator in said path for condensing moisture from air passing through said recirculation path.

27. A physiological apparatus according to claim 26 wherein said second means comprises a blower situated in direct communication with the interior of said chamber for blowing the air within said chamber over said person's body.

28. A physiological apparatus according to claim 27 wherein said closed recirculation path, said evaporator and said blower all are situated in an equipment compartment detachably connected to said chamber.

* * * * *